US009175554B1

(12) United States Patent
Watson

(10) Patent No.: US 9,175,554 B1
(45) Date of Patent: Nov. 3, 2015

(54) ARTIFICIAL LIFT FLUID SYSTEM

(71) Applicant: Alvin Watson, Pearland, TX (US)

(72) Inventor: Alvin Watson, Pearland, TX (US)

( * ) Notice: Subject to any disclaimer, the term of this patent is extended or adjusted under 35 U.S.C. 154(b) by 480 days.

(21) Appl. No.: 13/682,232

(22) Filed: Nov. 20, 2012

Related U.S. Application Data

(60) Provisional application No. 61/589,711, filed on Jan. 23, 2012.

(51) Int. Cl.
*E21B 43/12* (2006.01)
*E21B 19/16* (2006.01)

(52) U.S. Cl.
CPC ..... *E21B 43/128* (2013.01); *E21B 19/16* (2013.01); *E21B 43/121* (2013.01); *E21B 43/126* (2013.01)

(58) Field of Classification Search
CPC ..... E21B 43/126; F04D 29/044
See application file for complete search history.

(56) References Cited

U.S. PATENT DOCUMENTS 2,104,339 A * 1/1938 Arutunoff ..... 166/105.1
2,171,171 A * 8/1939 Brauer ..... 166/68
4,235,569 A * 11/1980 Wegner et al. ..... 415/122.1
5,941,305 A * 8/1999 Thrasher et al. ..... 166/53
5,960,886 A 10/1999 Morrow
7,836,950 B2 11/2010 Vail, III et al.
7,854,259 B2 12/2010 Davison
8,336,632 B2 * 12/2012 Morrow et al. ..... 166/380
2001/0050168 A1 * 12/2001 Hult ..... 166/68.5
2007/0235196 A1 * 10/2007 Brown et al. ..... 166/369
2011/0048738 A1 * 3/2011 Morrow et al. ..... 166/380
2013/0330211 A1 * 12/2013 Morrow ..... 417/62

* cited by examiner

*Primary Examiner* — Giovanna C Wright
(74) *Attorney, Agent, or Firm* — Buskop Law Group, PC; Wendy Buskop

(57) ABSTRACT

An artificial lift fluid system for use in a wellbore with a casing engaging a well head can include a prime mover in communication with a variable frequency drive controller, or connected with a throttle, sensors, and a programmable logic controller for optimizing production from the wellbore by comparing data with preset production parameters. The artificial lift fluid system can include upper bearings connected to the prime mover, and an on-off tool connected with a shaft. The shaft can be engaged with the upper bearings, prime mover, and the on-off tool. The on-off tool can be connected with the centrifugal pump. A seal can be engaged with the shaft, a bottom bearing can be connected with the centrifugal pump to support loads, and bushings can separate the on-off tool and shaft from tubing in the casing.

20 Claims, 8 Drawing Sheets

ARTIFICIAL LIFT FLUID SYSTEM

CROSS REFERENCE TO RELATED APPLICATION

The current application claims priority to and the benefit of U.S. Provisional Patent Application Ser. No. 61/589,711 filed on Jan. 23, 2012, entitled "ARTIFICIAL LIFT FLUID SYSTEM." This reference in incorporated in its entirety.

FIELD

The present embodiments generally relate to an artificial lift fluid system for use in a wellbore with casing engaging a well head.

BACKGROUND

A need exists for an artificial lift fluid system having a low capital cost, low installation cost, low maintenance requirements, wide production range, high temperature operation, high system efficiency, tolerance to abrasives, low profile, and low rod torque.

A further need exists for an artificial lift fluid system that can allow for deeper setting of a shaft driving a centrifugal pump into the wellbore by having dual independent load support of the shaft and the centrifugal pump, and having an on-off tool with male and female connections.

A further need exists for an artificial lift fluid system that does not require pulling the centrifugal pump to change shaft or bushings.

A further need exists for an artificial lift fluid system that can be powered by gas or hydraulic motors.

A further need exists for an artificial lift fluid system having a plurality of bushings disposed longitudinally along the shaft and an on-off tool for separating the shaft and on-off tool from tubing in the casing.

The present embodiments meet these needs.

BRIEF DESCRIPTION OF THE DRAWINGS

The detailed description will be better understood in conjunction with the accompanying drawings as follows.

Figure 1A:
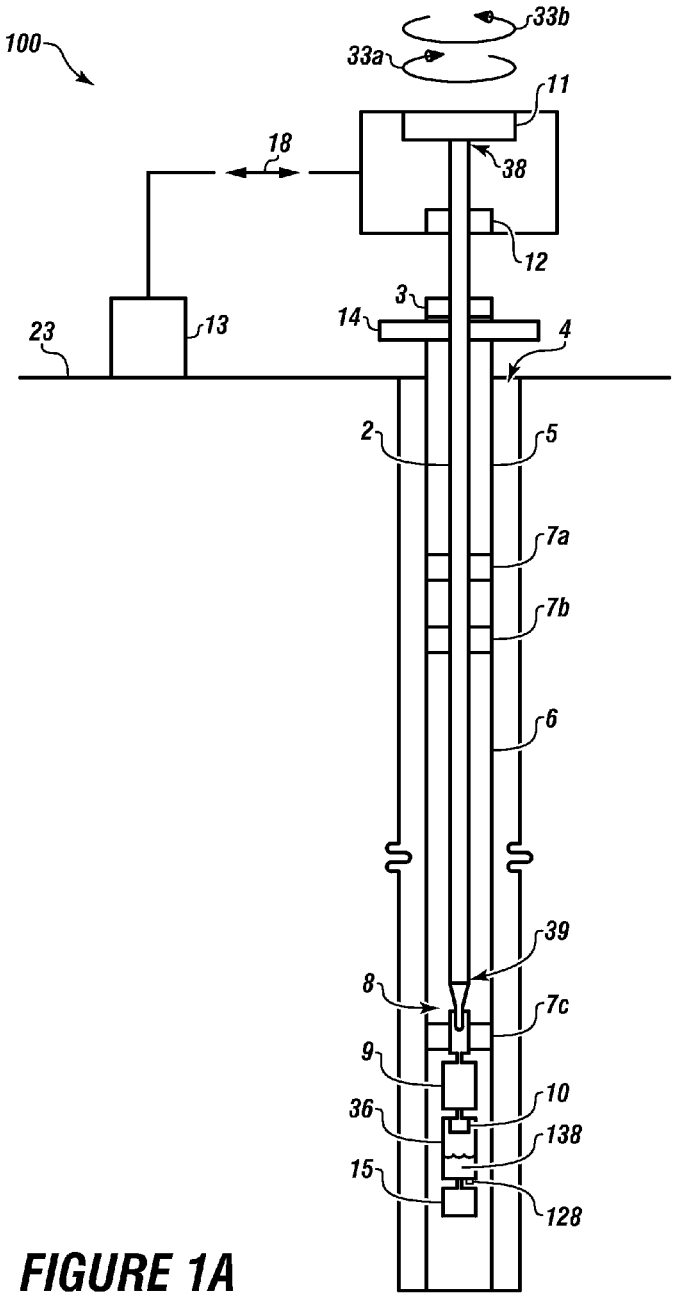
FIG. 1A depicts a cross sectional view of the artificial lift fluid system according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments relate to an artificial lift fluid system for use in a wellbore with casing engaging a well head. The wellbore can be an oil wellbore, gas wellbore, water wellbore, other hydrocarbon wellbore, or the like.

In one or more embodiments, the wellbore does not need to be attached to the well head.

In one or more embodiments, the artificial lift fluid system can have a low capital cost. For example, in one or more embodiments, the artificial lift fluid system can cost $50,000.

The artificial lift fluid system can have a low installation cost. For example, the artificial lift fluid system can require a smaller surface area for installation when compared to other systems, use a prime mover at the surface, and use reduced diameter shafts.

The artificial lift fluid system can have low maintenance requirements. For example, using the prime mover at the surface allows for easy and more affordable maintenance.

The artificial lift fluid system can have a wide production range. For example, in one or more embodiments, the artificial lift fluid system can have a production range of 400 barrels of fluid per day to 730 barrels of fluid per day.

The artificial lift fluid system can have a high temperature operation. For example, in one or more embodiments, the artificial lift fluid system can operate at temperatures ranging from 150 degrees Fahrenheit to 400 degrees Fahrenheit.

The artificial lift fluid system can have a high system efficiency. For example, in one or more embodiments, the artificial lift fluid system can require only 13 horse power to produce 600 barrels of fluid per day. For example, in one or more embodiment, the artificial lift fluid system can operate at 30 horse power and 70 percent centrifugal pump efficiency to produce 2000 barrels of fluid per day at a depth of 2000 feet in the wellbore, and operate at 75 horse power and 70 percent centrifugal pump efficiency to produce 2000 barrels of fluid per day at a depth of 5000 feet in the wellbore.

In one or more embodiments, the artificial lift fluid system can operate at 60 percent efficiency compared to 55 percent efficiency for a progressive cavity pump, 45 percent efficiency for an electrical submersible pump, and 50 percent efficiency for a beam pump.

The artificial lift fluid system can be more tolerant to abrasives than an electrical submersible pump. For example, the artificial lift fluid system can be operated at a lower revolutions per minute than a typical centrifugal pump, which reduces velocity of the fluid; thereby reducing wear caused by the fluid on the centrifugal pump.

The artificial lift fluid system can have a low profile compared to other systems.

The artificial lift fluid system can have a low shaft torque. For example, in one or more embodiment, the shaft torque can be up to six times lower than a progressive cavity pump.

In one or more embodiment of the artificial lift fluid system, the shaft and bushings can be changed without pulling the centrifugal pump due to the male and female connections of the on-off tool.

In operation, the artificial lift fluid system can be used to produce fluid from the wellbore with the casing and well head.

For example, the bottom bearings can be connected to the centrifugal pump to form a bottom hole assembly.

The bottom hole assembly can be connected to the tubing and lowered into the wellbore to various depths.

The shaft, such as a sucker rod, can be lowered down through the tubing and connected to the centrifugal pump via the on-off tool. For example, the shaft can be run into the wellbore; and a second end of the shaft can be connected with the on-off tool, which can be connected with the bottom hole assembly.

The shaft can be run into the wellbore using a pulling unit located at the surface of the wellbore. In embodiments, the on-off tool can have a female or male connection engaged with the centrifugal pump, and a female or male connection engaged with the shaft.

In one or more embodiments, the on-off tool and the shaft can have a plurality of bushings disposed longitudinally thereon. The plurality of bushings can separate the on-off tool and the shaft from the tubing in the casing. It is possible for the shaft to not have bushings.

The bottom hole assembly can be run into the wellbore on the tubing from the surface.

A first end of the shaft can be connected through a seal and engaged with upper bearings and the prime mover, which can be a reversible prime mover.

In embodiments with an electric or hydraulic prime mover, a variable frequency drive controller can be connected with the prime mover for varying a drive speed for the prime mover.

The variable frequency drive controller can cause the prime mover to rotate the shaft in a first direction; thereby rotating the centrifugal pump to pump fluid from the wellbore.

In embodiments with diesel engine or natural gas engine prime mover, a throttle can be connected with the prime mover for varying the drive speed for the prime mover.

The throttle can cause the prime mover to rotate the shaft in the first direction; thereby rotating the centrifugal pump to pump the fluid from the wellbore. For example, the shaft can rotate the centrifugal pump, which can pump the fluid up the casing, tubing, or shaft. In embodiments, the centrifugal pump can pump the fluid up the tubing between the casing and the shaft.

In embodiments, the shaft can be hollow, and the centrifugal pump can pump the fluid up the hollow shaft to the well head. The fluid can be oil, gas, water, another hydrocarbon, or the like.

In one or more embodiments, the centrifugal pump can be attached to the shaft and lowered into the tubing to attach to a downhole packer for producing up the casing or inside large diameter tubing. The pump can also be attached to the tubing as the tubing is set into the wellbore.

One or more embodiments can include a check valve to prevent fluid back flow in the tubing.

The centrifugal pump can be driven from the surface using the shaft; allowing the centrifugal pump to have a larger diameter because an electric cable does not have to be attached to an electric motor within the wellbore.

Figure 1B:
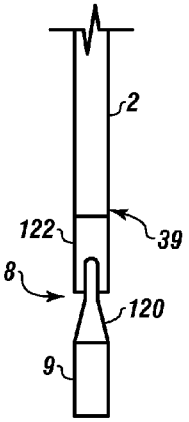
FIG. 1B depicts a detail view of the on-off tool in a different embodiment.
Figure 2A:
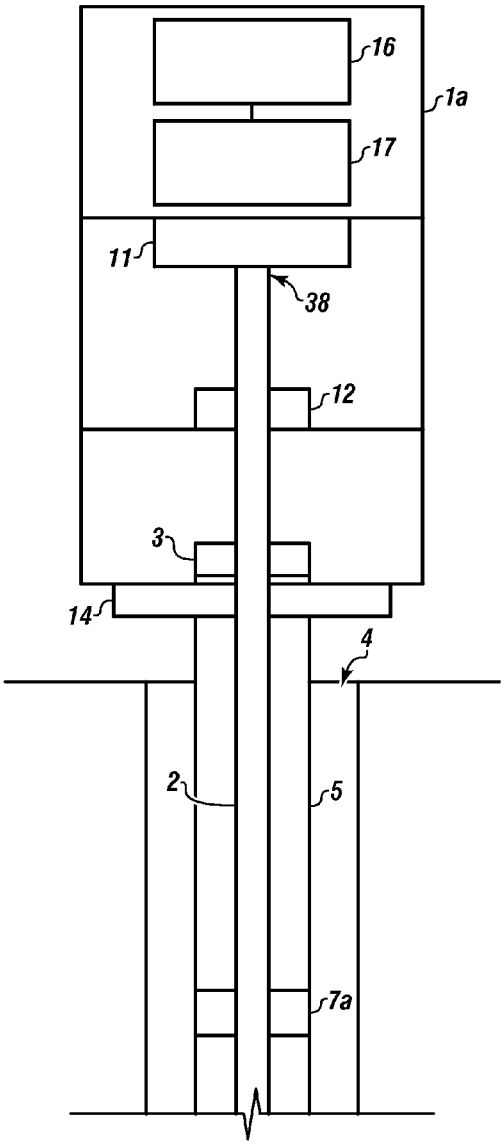
FIG. 2A depicts a detailed cross sectional view of a portion of the artificial lift fluid system of FIG. 1A.
Figure 2B:
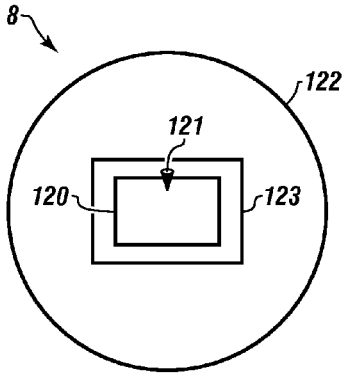
FIG. 2B depicts another detail view of the on-off tool.

Turning now to the Figures, FIG. 1A depicts a cross sectional view of the artificial lift fluid system 100 according to one or more embodiments, FIG. 1B depicts a detail view of the on-off tool 8 in a different embodiment, FIG. 2A depicts a detailed cross sectional view of portions of the artificial lift fluid system 100 of FIG. 1A, and FIG. 2B depicts another detail view of the on-off tool 8.

The artificial lift fluid system 100 can be used in a wellbore 4 with a casing 6 engaging a well head 14.

The artificial lift fluid system 100 can be configured for use when there is insufficient pressure in the wellbore 4 to lift the fluids to a surface 23 or increase a flow rate of the fluid from the wellbore 4.

The fluid from the wellbore 4 can be oil, water, gas, or mixtures thereof.

The artificial lift fluid system 100 can include a prime mover 1*a*. The prime mover 1*a* can be configured to provide from one horse power to five hundred horse power using from one kilowatt to five hundred kilowatts.

The prime mover 1*a* can include an electric motor 16, a hydraulic system 17, or combinations thereof. In one or more embodiments, the prime mover 1*a* can be solar or wind powered.

A variable frequency drive controller 13 can be in communication with the prime mover 1*a*.

The variable frequency drive controller 13 can be configured to vary a drive speed of the prime mover 1*a*; thereby optimizing production from the wellbore 4.

The variable frequency drive controller 13 can receive data 18 from the prime mover 1*a*.

The data 18 can include pump fillage, underload, torque, revolutions per minute, voltage, frequency, and current.

The variable frequency drive controller 13 can compare the received data 18 from the prime mover 1*a* with preset production parameters for optimizing operation of the variable frequency drive controller 13; thereby optimizing production from the wellbore 4.

The artificial lift fluid system 100 can include upper bearings 11 connected to the prime mover 1*a*. The upper bearings 11 can be configured to support loads of the shaft 2, and the prime mover 1*a* can be configured to rotate the shaft 2.

For example, the loads supported by the upper bearings 11 can be up to about one hundred thousand pounds.

The upper bearings 11 can be ball bearings, roller bearings, sleeve bearings, pivot shoe bearings, or combinations thereof.

The artificial lift fluid system 100 can include an on-off tool 8 connected with the shaft 2. The shaft 2 can be configured to rotate in a first direction 33*a*.

The on-off tool 8 can include a male connection 120 engaged to a female connection 122. In operation, the on-off tool 8 can engage a second end 39 of the shaft 2 via the male connection 120, and the female connection 122 can engage the centrifugal pump 9, or the on-off tool 8 can engage the second end 39 of the shaft 2 via the female connection 122 and the male connection 120 can engage the centrifugal pump 9.

In one or more embodiments, the engagement of the female connection 122 to the male connection 120 can be configured to allow the male connection 120 to transfer only rotational force to the female connection 122, such as the rotation force from the shaft 2.

In one or more embodiments, the engagement of the female connection 122 to the male connection 120 can be configured to allow the female connection 122 to transfer only rotational force to the male connection 120, such as the rotation force from the shaft 2.

For example, the male connection 120 can have a rectangular shaped end 121, the female connection 122 can have a rectangular shaped opening 123, and the rectangular shaped end 121 can be configured to fit within the rectangular shaped opening 123 in a first position without engaging the female connection 122. In operation, when the male connection 120 rotates, the male connection 120 can engage the rectangular shaped opening 123; thereby allowing the male connection 120 to transfer rotation force to the female connection 122.

The shaft 2 can be hollow or solid, and can have an outer diameter ranging from about 0.5 inches to about 2 inches. The shaft 2 can be made of stainless steel, carbon steel, chrome plated carbon steel, or alloys of steel.

The shaft 2 can have a first end 38 opposite the second end 39. The shaft 2 can engage the upper bearings 11 at the first end 38; thereby operatively engaging the shaft 2 with the prime mover 1*a*.

In one or more embodiments, the prime mover 1*a* can be directly coupled to the shaft 2 or connected through belts, sheaves, gears, or hydraulic means.

The connection between the centrifugal pump 9 and the shaft 2 can allow weight of the shaft 2 to be supported by the upper bearings 11 and thrust of the centrifugal pump 9 to be supported by bottom bearings 10; thereby providing dual independent load support.

In one or more embodiments, the shaft 2 can be connected with the centrifugal pump 9 just above the centrifugal pump 9; thereby allowing for connection and disconnection of the shaft 2. As such, the connection between the centrifugal pump 9 and the shaft 2 can also allow for length adjustments to the shaft 2.

The centrifugal pump 9 can be connected with the on-off tool 8. The centrifugal pump 9 can be a radial flow, mixed flow, turbine, or fixed or floating impeller design; and can be operated at various revolutions per minute. Impellers and diffusers of the centrifugal pump 9 can be coated with abrasive and heavy fluids.

In operation, the centrifugal pump 9 can be driven by the shaft 2.

The centrifugal pump 9 can have a fluid capacity ranging up to about fifty thousand barrels per day.

A seal 3 can be engaged with the shaft 2 between the upper bearings 11 and the well head 14. The seal 3 can be a mechanical seal or a packing seal.

The bottom bearings 10 can be connected with the centrifugal pump 9. The bottom bearing 10 can be configured to support loads from the centrifugal pump 9. The bottom bearings 10 can support a thrust load, radial load, or combinations thereof; of the centrifugal pump 9.

For example the bottom bearings 10 can be disposed below the centrifugal pump 9; thereby allowing for the upper bearings 11 to support the loads of the shaft 2 and the bottom bearings 10 to support the loads of the centrifugal pump 9. Furthermore, with the bottom bearings 10 below the centrifugal pump 9, pressure drop of the fluid produced by the centrifugal pump 9 can be reduced by being disposed outside of the flow of the fluid.

In one or more embodiments, the bottom bearings 10 can be contained in a housing 36 containing a lubricating and cooling fluid 138 that allows the lubricating and cooling fluid 138 to expand or retract without damaging the bottom bearings 10.

A plurality of bushings 7*a*, 7*b* and 7*c* can be disposed longitudinally along the shaft 2, the on-off tool 8, or combinations thereof. The plurality of bushings 7*a*-7*c* can be configured to separate the shaft 2, the on-off tool 8, or combinations thereof from the tubing 5 in the casing 6, and provide radial support to the shaft 2, the on-off tool 8, or combinations thereof.

The location and number of the plurality of bushings 7*a*-7*c* can be based upon a necessity to prevent excessive vibration and wearing of the shaft 2, the casing 6, and the tubing 5.

The plurality of bushings 7*a*-7*c* can be solid bushings that are sleeved or flanged, split bushings, or clenched bushings.

The plurality of bushings 7*a*-7*c* can centralize the shaft 2 and the on-off tool 8 within the tubing 5 or casing 6; thereby reducing vibration and wear on the tubing 5, the casing 6, the on-off tool 8, and the shaft 2. The plurality of bushings 7*a*-7*c* can be cooled and lubricated by well fluid.

In operation, with the engagement of the female connection 122 to the male connection 120 configured to allow the female connection 122 to transfer only rotational force to the male connection 120, the shaft 2 can expand and contract without damaging the centrifugal pump 9, the bottom bearings 10, the plurality of bushings 7*a*-7*c*, the seal 3, and the prime mover 1*a*.

In one or more embodiments, the plurality of bushings 7*a*-7*c* can have one or more vanes, which can maintain the shaft 2 disposed away from the tubing 5 or casing 6, to prevent or reduce turning of the plurality of bushings 7*a*-7*c*, and to prevent or reduce wearing against the casing 6 and a fluid passage in the wellbore 4.

The plurality of bushings 7*a*-7*c* can turn directly on the shaft 2 or on a cylinder connected to the shaft 2, and can be made of a hardened material.

In one or more embodiments, the plurality of bushings 7*a*-7*c* can be attached to walls of the tubing 5, which can be a firm attachment or a loose attachment.

In one or more embodiments, the artificial lift fluid system 100 can include a gas separator 15 in fluid communication with the bottom bearing 10. The gas separator 15 can be configured to separate gas from other fluid that is pumped by the centrifugal pump 9. The gas separator 15 can be a mechanical or passive system.

In one or more embodiments, the artificial lift fluid system 100 can include a back spin 12 disposed between the prime mover 1*a* and the seal 3 or well head 14. The back spin 12 can be configured to prevent the shaft 2 from rotating in a second direction 33*b* when the fluid flows back into the wellbore 4.

The first direction 33*a* and the second direction 33*b* can each be clockwise or counterclockwise.

In one or more embodiments, a check valve 128 can be connected at a bottom of the centrifugal pump 9. The check valve 128 can be configured to prevent the fluid from flowing into the wellbore 4 from the centrifugal pump 9.

Figure 3A:
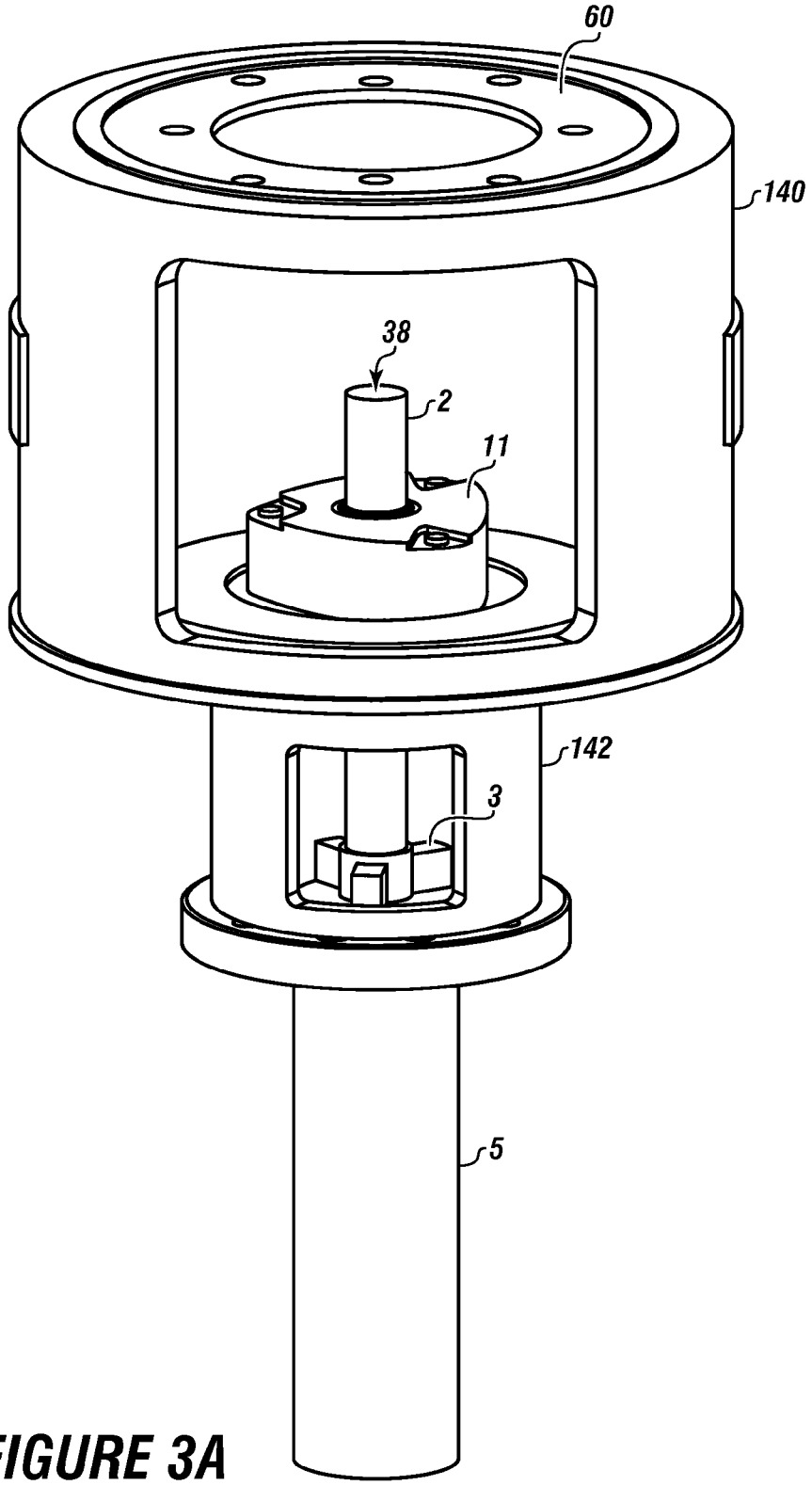
FIGS. 3A-3B depict detailed cross sectional views of another portion of the artificial lift fluid system.
Figure 3B:
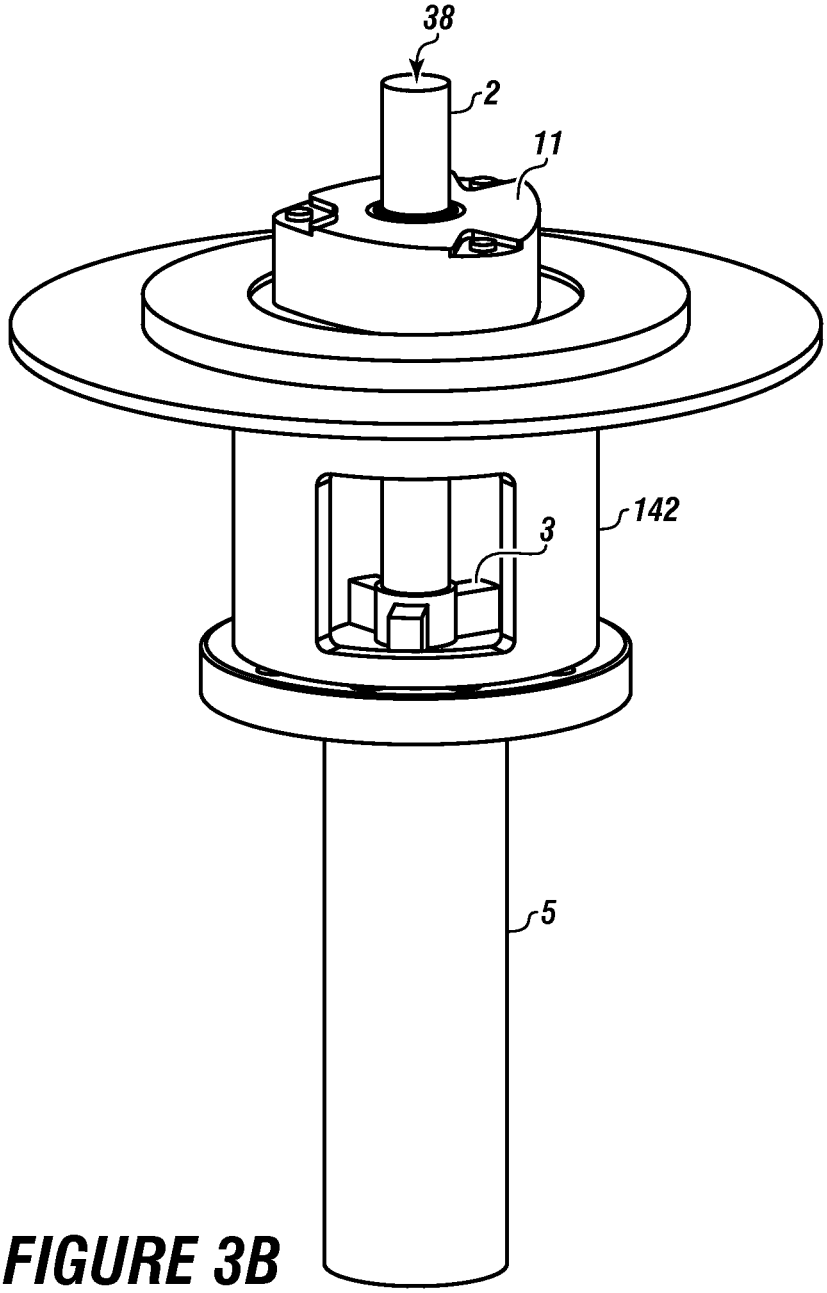

FIG. 3A depicts a detail view of another portion of the artificial lift fluid system without the prime mover installed, and FIG. 3B depicts a detail view of another portion of the artificial lift fluid system without the prime mover installed and without an upper bearing housing 140 installed.

The upper bearing housing 140 can have a mount 60 for mounting the prime mover thereon. When installed, the prime mover can be coupled with the upper bearings 11 within the upper bearing housing 140.

The first end 38 of the shaft 2 can be engaged with the upper bearings 11.

The seal 3 can be disposed within a seal housing 142 above the tubing 5.

Figure 4:
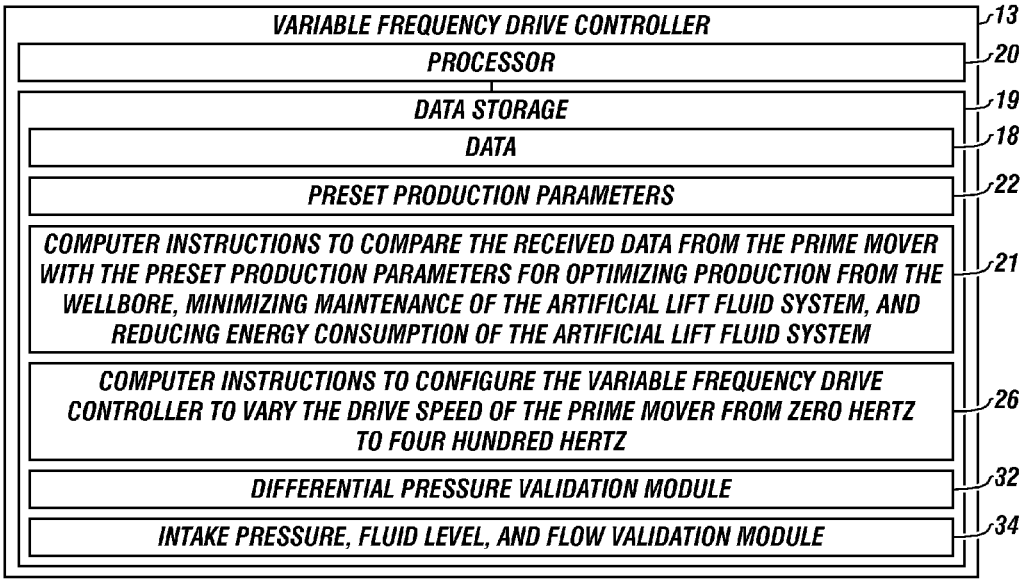
FIG. 4 depicts a diagram of a variable frequency drive controller according to one or more embodiments.

FIG. 4 depicts a diagram of a variable frequency drive controller 13 according to one or more embodiments.

The variable frequency drive controller 13 can include a processor 20 and a data storage 19.

The data storage 19 can have the data 18 and the preset production parameters 22 stored therein. The data 18 and the preset production parameters 22 can include pump fillage, underload, torque, revolutions per minute, voltage, frequency, current, or combinations thereof.

The data storage 19 can include computer instructions to compare the received data from the prime mover with the preset production parameters for optimizing production from the wellbore, minimizing maintenance of the artificial lift fluid system, and reducing energy consumption of the artificial lift fluid system 21.

For example, if the data 18 is determined to be outside of the present production parameters 22, the variable frequency drive controller 13 can change the revolutions per minute of the centrifugal pump.

The data storage 19 can have computer instructions to configure the variable frequency drive controller to vary the drive speed of the prime mover from zero hertz to four hundred hertz 26.

As such, the variable frequency drive controller 13 can maintain torque without moving the shaft.

The variable frequency drive controller 13 can be configured to receive the data 18 from the prime mover and use the data 18 to estimate a torque of the prime mover.

For example, the torque of the prime mover can be estimated by analyzing DC current of the variable frequency drive controller 13, or by analyzing AC current and performing a vector calculation thereon.

The data storage 19 can have a differential pressure validation module 32 to validate a differential pressure across the centrifugal pump. For example, the data 18 can be used by the variable frequency drive controller 13 to determine the torque and speed of the prime mover, and the differential pressure validation module 32 can be use the determined torque and speed of the prime mover to execute an algorithm to determine the differential pressure across the centrifugal pump.

The data storage 19 can have an intake pressure, fluid level, and flow validation module 34 to validate an intake pressure, a fluid level, flow, or combination thereof for the centrifugal pump. For example, the data 18 can be used by the variable frequency drive controller 13 to determine the torque, speed, and time of the prime mover, and the intake pressure, fluid level, and flow validation module 34 can be use the determined torque, speed, and time of the prime mover to execute an algorithm to determine the intake pressure, the fluid level, the flow or combination thereof.

Figure 5:
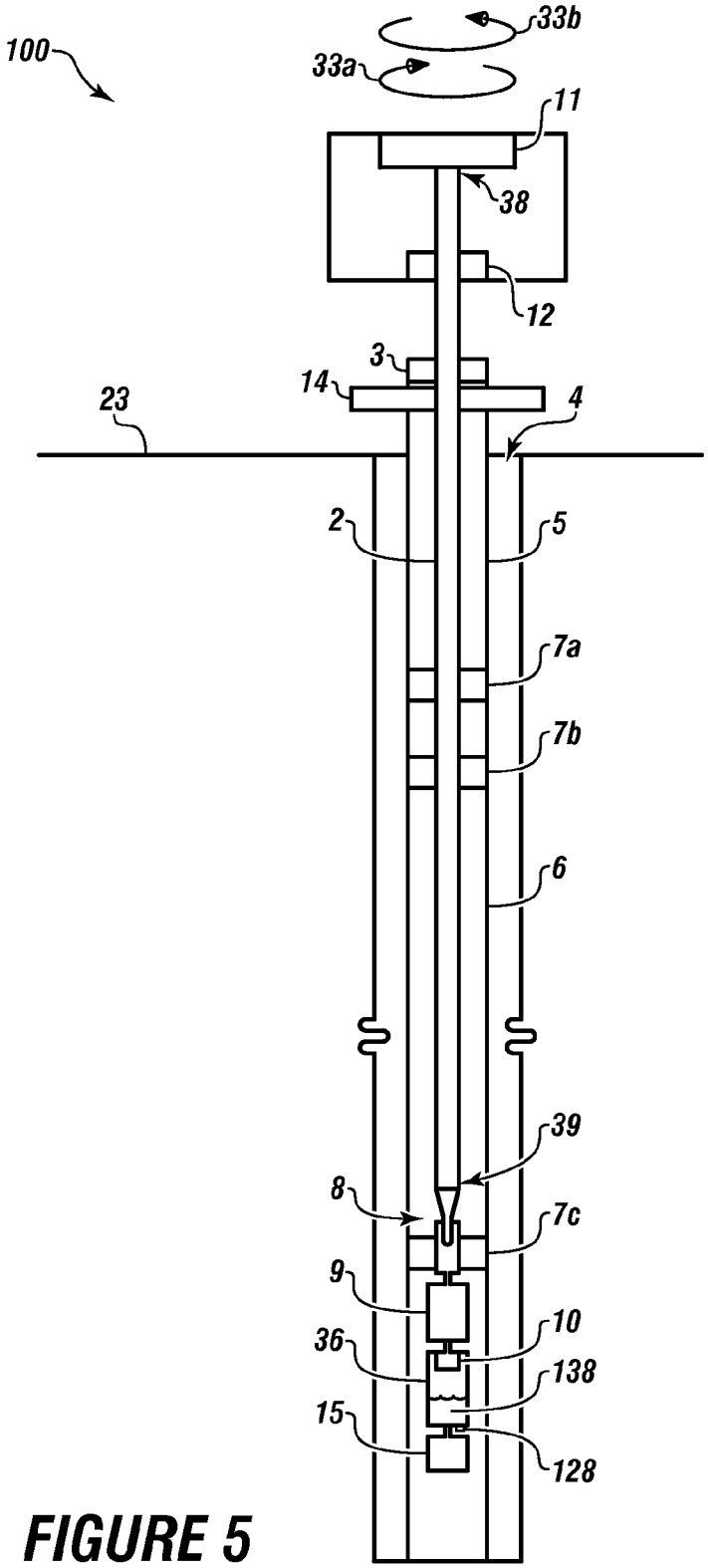
FIG. 5 depicts a cross sectional view of another embodiment of the artificial lift fluid system.
Figure 6:
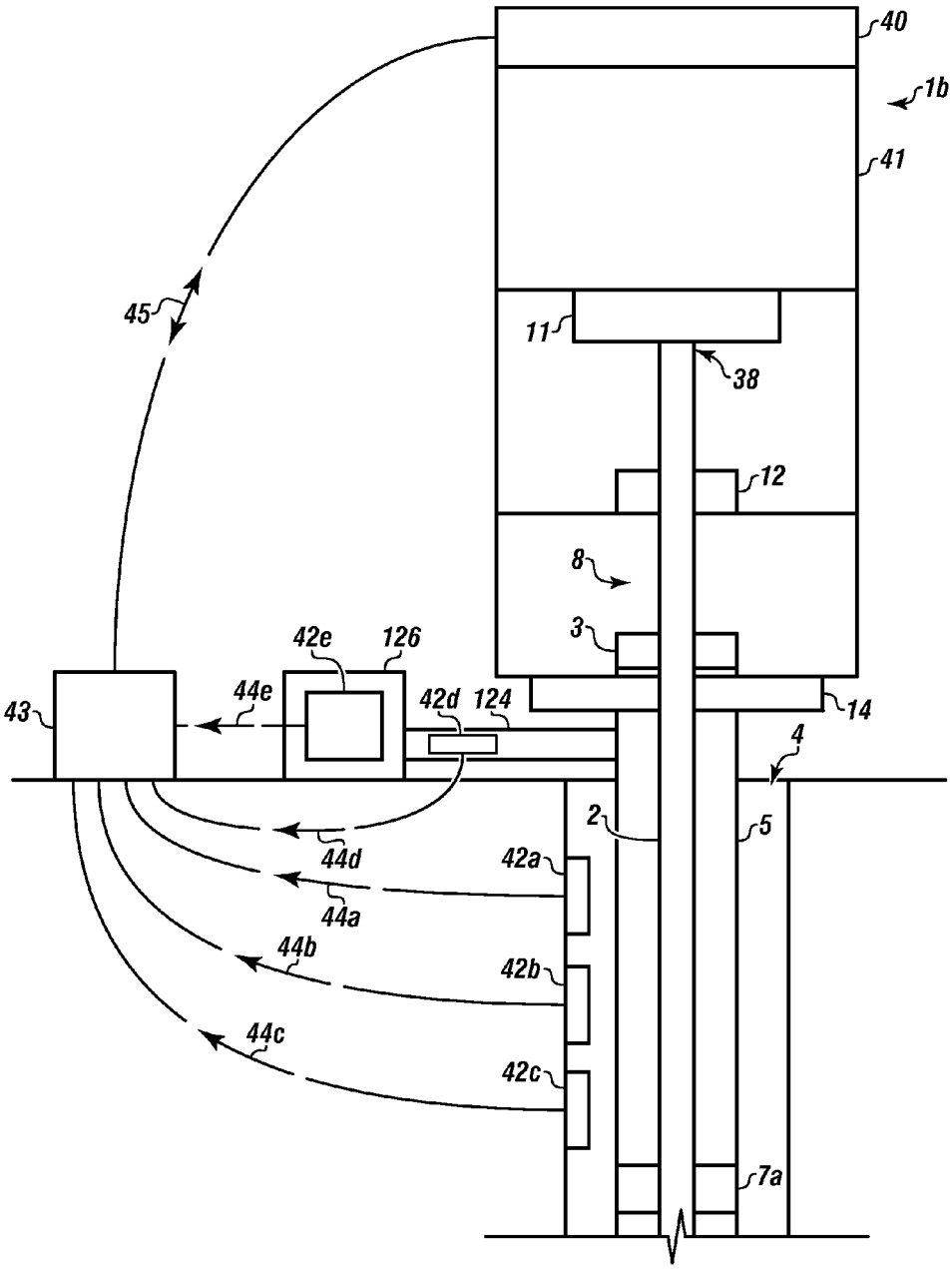
FIG. 6 depicts a detailed cross sectional view of portions of the artificial lift fluid system of FIG. 5.

FIG. 5 depicts a cross sectional view of another embodiment of the artificial lift fluid system 100, and FIG. 6 depicts a detailed cross sectional view of portions of the artificial lift fluid system 100 of FIG. 5.

The artificial lift fluid system 100 can be used in the wellbore 4 with the casing 6 engaging the well head 14.

The artificial lift fluid system 100 can have a prime mover 1*b*, which can be configured to provide from one horse power to five hundred horse power using from one kilowatt to five hundred kilowatts.

The prime mover 1*b* can include a natural gas engine, diesel engine, or combinations thereof 41.

A throttle 40 can be connected with the prime mover 1*b*. The throttle 40 can be configured to vary a drive speed of the prime mover 1*b*; thereby optimizing production from the wellbore 4.

The throttle 40 can be a mechanism configured to regulate a power or speed of the natural gas engine, a diesel engine, or combinations thereof 41.

The artificial lift fluid system 100 can have a plurality of pressure, temperature, flow rate, and load sensors 42*a*, 42*b*, 42*c*, 42*d* and 42*e*, which can be disposed in the wellbore 4, casing 6, a flow line 124, a storage tank 126, or combinations thereof.

The artificial lift fluid system 100 can have a programmable logic controller 43 in communication with the plurality of pressure, temperature, flow rate, and load sensors 42*a*-42*e*. The programmable logic controller 43 can also be in communication with the throttle 40.

The programmable logic controller 43 can be configured to receive sensor data 44*a*, 44*b*, 44*c*, 44*d* and 44*e* from the plurality of pressure, temperature, flow rate, and load sensors 42*a*-42*e*, compare the received sensor data 44*a*-44*e* to preset production parameters in the programmable logic controller 43, and optimize operation of the throttle 40 using control signals 45; thereby optimizing production from the wellbore 4.

The artificial lift fluid system 100 can have the upper bearings 11 connected to the prime mover 1*b*, the on-off tool 8, the shaft 2 configured to rotate in the first direction 33*a*, the first end 38 engaged with the upper bearings 11, the second end 39 engaged with the centrifugal pump 9, the seal 3 engaged with the shaft 2 between the well head 14 and the upper bearings 11, the bottom bearings 10 connected with the centrifugal pump 9 to support loads, the plurality of bushings 7*a*-7*c* disposed longitudinally along the shaft 2 and the on-off tool 8, the gas separator 15 in fluid communication with the bottom bearings 10, and the back spin 12 disposed between the prime mover 1*b* and the seal 3 to prevent the shaft 2 from rotating in the second direction 33*b* when the fluid flows back into the wellbore 4 as discussed herein.

In one or more embodiments, the bottom bearings 10 can be contained in the housing 36 containing and the lubricating and cooling fluid 138 that allows the lubricating and cooling fluid 138 to expand or retract without damaging the bottom bearings 10.

Also depicted are the tubing 5, the surface 23, and a check valve 128.

Figure 7:
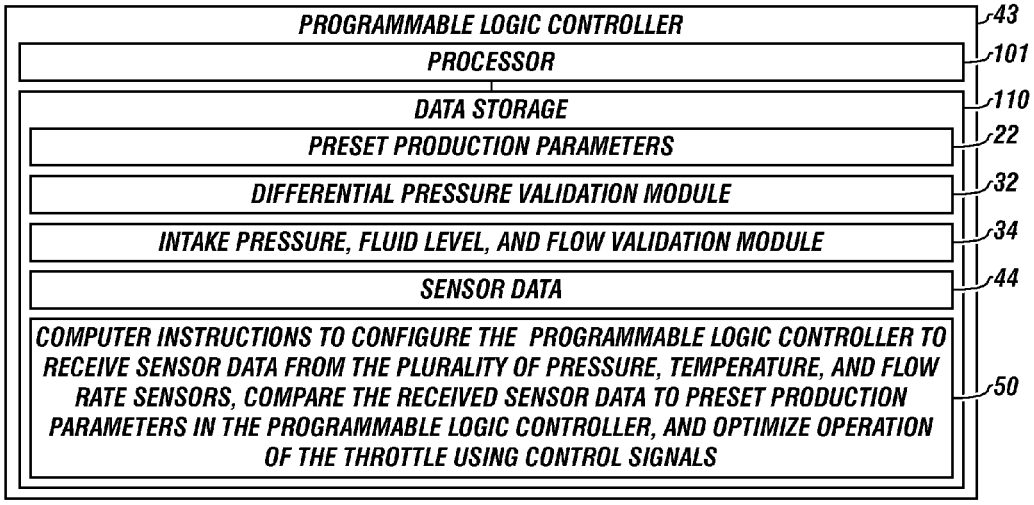
FIG. 7 depicts a diagram of a programmable logic controller according to one or more embodiments.

FIG. 7 depicts a diagram of the programmable logic controller 43 according to one or more embodiments. The programmable logic controller 43 can have a processor 101 and a data storage 110.

The programmable logic controller 43 have computer instructions to configure the programmable logic controller to receive sensor data from the plurality of pressure, temperature, and flow rate sensors, compare the received sensor data to preset production parameters in the programmable logic controller, and optimize operation of the throttle using control signals 50.

For example, if the data is determined to be outside of the present production parameters 22, the programmable logic controller 43 can change the revolutions per minute of the centrifugal pump.

The programmable logic controller 43 can have the sensor data 44 and the preset production parameters 22 stored therein.

The programmable logic controller 43 can be configured to receive the sensor data 44 from the plurality of pressure, temperature, and flow rate sensors and use the sensor data 44 to estimate a torque of the prime mover.

The programmable logic controller 43 can have the differential pressure validation module 32 to validate a differential pressure across the centrifugal pump.

The programmable logic controller 43 can have an intake pressure, fluid level, and flow validation module 34 to validate an intake pressure, a fluid level, or combination thereof for the centrifugal pump.

While these embodiments have been described with emphasis on the embodiments, it should be understood that within the scope of the appended claims, the embodiments might be practiced other than as specifically described herein.

What is claimed is:

1. An artificial lift fluid system for use in a wellbore with a casing engaging a well head, the artificial lift fluid system comprising:

a. a prime mover, wherein the prime mover comprises a member of the group consisting of: a natural gas engine, a diesel engine, or combinations thereof;

b. upper bearings connected to the prime mover;

c. a throttle connected with the prime mover, wherein the throttle is configured to vary a drive speed of the prime mover and optimize production from the wellbore;

d. a shaft configured to rotate in a first direction, wherein the shaft comprises a first end and a second end, wherein the shaft engages the upper bearings at the first end, wherein the upper bearings are configured to support loads of the shaft, and wherein the prime mover is configured to rotate the shaft;

e. an on-off tool comprising a male connection engaged to a female connection, wherein the on-off tool:

(i) engages the second end of the shaft via the male connection, and the female connection engages a centrifugal pump; or (ii) engages the second end of the shaft via the female connection, and the male connection engages the centrifugal pump; and f. bottom bearings connected with the centrifugal pump, wherein the bottom bearings are configured to support loads from the centrifugal pump;

g. a plurality of pressure, temperature, flow rate, and load sensors disposed in the wellbore, the casing, a flow line, a storage tank, or combinations thereof; and h. a programmable logic controller connected with the plurality of pressure, temperature, flow rate, and load sensors and the throttle, wherein the programmable logic controller is configured to receive sensor data from the plurality of pressure, temperature, flow rate, and load sensors, compare the received sensor data to preset production parameters in the programmable logic controller, and optimize operation of the throttle using control signals.

2. The artificial lift fluid system of claim 1, further comprising a plurality of bushings disposed longitudinally along the shaft, the on-off tool, or combinations thereof, wherein the plurality of bushings are configured to separate the shaft, the on-off tool, or combinations thereof from a tubing in the casing.

3. The artificial lift fluid system of claim 2, wherein the plurality of bushings:

a. provide radial support to the shaft;

b. centralize the shaft within the tubing or the casing, thereby reducing vibration and wear on the tubing, the casing, and the shaft;

c. are cooled and lubricated by well fluid; and d. have one or more vanes to maintain the shaft disposed away from the tubing or the casing to prevent or reduce turning of the plurality of bushings, and prevent or reduce wearing against the casing.

4. The artificial lift fluid system of claim 1, wherein the engagement of the female connection to the male connection is configured to:

a. allow the male connection to transfer only rotational force to the female connection; or b. allow the female connection to transfer only rotational force to the male connection.

5. The artificial lift fluid system of claim 1, further comprising a gas separator in fluid communication with the bottom bearings, wherein the gas separator is configured to separate gas from fluid that is pumped by the centrifugal pump.

6. The artificial lift fluid system of claim 1, further comprising a back spin disposed between the prime mover and the well head, wherein the back spin is configured to prevent the shaft from rotating in a second direction when the fluid flows back into the wellbore.

7. The artificial lift fluid system of claim 1, wherein:

a. the artificial lift fluid system is configured for use when there is insufficient pressure in the wellbore to lift the fluids to a surface or increase a flow rate of the fluid from the wellbore; and b. the fluid from the wellbore is oil, water, gas, or mixtures thereof.

8. The artificial lift fluid system of claim 1, wherein:

a. the upper bearings are ball bearings, roller bearings, sleeve bearings, pivot shoe bearings, or combinations thereof; and b. the loads supported by the upper bearings are up to one hundred thousand pounds.

9. The artificial lift fluid system of claim 1, wherein the shaft:

a. is hollow or solid;

b. has an outer diameter ranging from 0.5 inches to 2 inches; and c. comprises stainless steel, carbon steel, chrome plated carbon steel, or alloys of steel.

10. The artificial lift system of claim 1, wherein the centrifugal pump has a fluid capacity of up to fifty thousand barrels per day.

11. The artificial lift fluid system of claim 1, further comprising a seal engaged with the shaft between the upper bearings and the well head.

12. The artificial lift fluid system of claim 1, wherein the bottom bearings comprise a housing and a lubricating and cooling fluid within the housing, wherein the housing allows the lubricating and cooling fluid to expand or retract without damaging the bottom bearings.

13. The artificial lift fluid system of claim 1, wherein:

a. the prime mover is an electric motor, a hydraulic system, or combinations thereof;

b. a variable frequency drive controller is in communication with the prime mover, wherein the variable frequency drive controller is configured to vary a drive speed of the prime mover, optimize production from the wellbore, and receive data from the prime mover; and c. the variable frequency drive controller comprises a data storage in communication with a processor, and wherein the data storage comprises computer instructions to compare the received data from the prime mover with preset production parameters for optimizing production from the wellbore, minimizing maintenance of the artificial lift fluid system, and reducing energy consumption of the artificial lift fluid system.

14. The artificial lift fluid system of claim 13, wherein:

a. the variable frequency drive controller is configured to adjust the preset production parameters in real-time using the received data from the prime mover;

b. the variable frequency drive controller is configured to vary the drive speed of the prime mover from 0 hertz to 400 hertz;

c. the variable frequency drive controller is configured to receive the data from the prime mover and use the data to estimate a torque of the prime mover;

d. the variable frequency drive controller comprises a differential pressure validation module to validate a differential pressure across the centrifugal pump;

e. the variable frequency drive controller comprises an intake pressure and fluid level validation module to validate an intake pressure, a fluid level, or combination thereof for the centrifugal pump; and f. the preset production parameters comprise a member of the group consisting of: pump fillage, underload, torque, revolutions per minute, voltage, frequency, current, and combinations thereof.

15. The artificial lift fluid system of claim 1, wherein connection between the centrifugal pump and the shaft:

a. allows weight of the shaft to be supported by the upper bearings and allows thrust of the centrifugal pump to be supported by the bottom bearings; thereby providing dual independent load support; and b. allows the shaft to expand and contract without damaging the centrifugal pump, the bottom bearings, and the prime mover.

16. The artificial lift fluid system of claim 1, wherein connection between the centrifugal pump and the shaft allows for connection and disconnection of the shaft from the centrifugal pump, and allows for length adjustments to the shaft.

17. The artificial lift fluid system of claim 1, wherein the bottom bearings are disposed below the centrifugal pump, thereby:

a. allowing the upper bearings to support the loads of the shaft;

b. allowing the bottom bearings to support the loads of the centrifugal pump; and c. reducing a pressure drop of the fluid produced by the centrifugal pump.

18. The artificial lift fluid system of claim 1, wherein the throttle is a mechanism configured to regulate a power or speed of the prime mover.

19. The artificial lift fluid system of claim 1, wherein the programmable logic controller:

a. is configured to adjust the preset production parameters in real-time using the received sensor data from the plurality of pressure, temperature, flow rate, and load sensors;

b. is configured to receive the sensor data from the plurality of pressure, temperature, flow rate, and load sensors and use the sensor data to estimate a torque of the prime mover;

c. comprises a differential pressure validation module to validate a differential pressure across the centrifugal pump; and d. comprises an intake pressure and fluid level validation module to validate an intake pressure, a fluid level, or combination thereof for the centrifugal pump.

20. The artificial lift fluid system of claim 1, further comprising a check valve connected at a bottom of the centrifugal pump, wherein the check valve is configured to prevent the fluid from flowing into the wellbore from the centrifugal pump.

* * * * *